United States Patent [19]

Gans

[11] 4,145,695

[45] Mar. 20, 1979

[54] LAUNCHER REFLECTORS FOR CORRECTING FOR ASTIGMATISM IN OFF-AXIS FED REFLECTOR ANTENNAS

[75] Inventor: Michael J. Gans, Tinton Falls, N.J.

[73] Assignee: Bell Telephone Laboratories, Incorporated, Murray Hill, N.J.

[21] Appl. No.: 773,185

[22] Filed: Mar. 1, 1977

[51] Int. Cl.[2] ..... H01Q 19/14; H01Q 19/10

[52] U.S. Cl. ..... 343/779; 343/781 CA; 343/781 P; 343/837

[58] Field of Search ..... 343/779, 781 CA, 781 P, 343/837

[56] References Cited

U.S. PATENT DOCUMENTS

| | | | |
|---|---|---|---|
| 3,146,451 | 8/1964 | Sternberg | 343/753 |
| 3,569,975 | 3/1971 | Fretz, Jr. | 343/781 |
| 3,688,311 | 8/1972 | Salmon | 343/781 |
| 3,737,909 | 6/1973 | Bartlett et al. | 343/781 |
| 3,792,480 | 2/1974 | Graham | 343/781 |
| 3,821,746 | 6/1974 | Mizusawa et al. | 343/781 |
| 3,828,352 | 8/1974 | Drabowitch et al. | 343/837 |
| 3,922,682 | 11/1975 | Hyde | 343/779 |
| 3,995,275 | 11/1976 | Betsudan et al. | 343/781 CA |

OTHER PUBLICATIONS

E. A. Ohm & M. J. Gans, *Numerical Analysis of Multiple-Beam Offset Cassegrainian Antennas*, in AIAA/-CASI 6th Commun. Satellite Sys. Conf. Montreal, Canada, Apr. 5-8, 1976, paper 76-301.

*Primary Examiner*—Alfred E. Smith
*Assistant Examiner*—Harry Barlow
*Attorney, Agent, or Firm*—Erwin W. Pfeifle

[57] ABSTRACT

The present invention relates to novel launcher reflectors which are used with reflector antenna systems to compensate for the dominant aberration of astigmatism which was found to be introduced in the signals being radiated and/or received at the off-axis positions. A major portion of such phase error is corrected by using, with each off-axis feedhorn, an astigmatic launcher reflector having a curvature and orientation of its two orthogonal principal planes of curvature which are chosen in accordance with specific relationships, the launcher reflector being fed by a symmetrical feedhorn.

4 Claims, 9 Drawing Figures

LAUNCHER REFLECTORS FOR CORRECTING FOR ASTIGMATISM IN OFF-AXIS FED REFLECTOR ANTENNAS

BACKGROUND OF THE INVENTION

1. Field of the Invention

The present invention relates to launcher reflectors which are used in reflector antennas to correct for astigmatism in signals radiated and/or received at a feedhorn located in an off-axis position and, more particularly, to launcher reflectors, for use in reflector antennas, which have the curvature and orientation of their two orthogonal principal planes of curvature chosen in accordance with a particular relationship to substantially correct for astigmatism introduced in the waveform radiated and/or received at an off-axis position.

2. Description of the Prior Art

Except for possibly the axial beam of a paraboloidal antenna, reflectors generally will suffer from some sort of aberration if the feedhorn must be located away from the geometrical focus so that a reflected planar wavefront is not produced. This is especially true in a multibeam reflector antenna system. Antenna systems, however, have been previously devised to correct for certain aberrations which have been found to exist.

U.S. Pat. No. 3,146,451 issued to R. L. Sternberg on Aug. 25, 1964 relates to a microwave dielectric lens for focusing microwave energy emanating from a plurality of off-axis focal points into respective collimated beams angularly oriented relative to the lens axis. In this regard also see U.S. Pat. No. 3,737,909 issued to H. E. Bartlett et al. on June 5, 1973.

U.S. Pat. No. 3,569,795 issued to G. C. Fretz, Jr. on Mar. 9, 1971 relates to apparatus for altering an electromagnetic wave phase configuration to a predetermined nonplanar front to compensate for radome phase distortion and which wave, upon exiting the radome, has a phase front which is planar.

Other antenna system arrangements are known which use subreflectors and the positioning of feedhorns to compensate for aberrations normally produced by such antenna systems. In this regard see, for instance U.S. Pat. Nos. 3,688,311 issued to J. Salmon on Aug. 29, 1972; 3,792,480 issued to R. Graham on Feb. 12, 1974; and 3,821,746 issued to M. Mizusawa et al. on June 28, 1974.

U.S. Pat. No. 3,828,352 issued to S. Drabowitch et al. on Aug. 6, 1974 relates to microwave antennas including a toroidal reflector designed to reduce spherical aberrations. The patented antenna structure comprises a first and a second toroidal reflector centered on a common axis of rotation, each reflector having a surface which is concave toward that common axis and has a vertex located in a common equatorial plane perpendicular thereto.

U.S. Pat. No. 3,922,682 issued to G. Hyde on Nov. 25, 1975 relates to an aberration correcting subreflector for a toroidal reflector antenna. More particularly, an aberration correcting subreflector has a specific shape which depends on the specific geometry of the main toroidal reflector. The actual design is achieved by computing points for the surface of the subreflector such that all rays focus at a single point and that all pathlengths from a reference plane to the point of focus are constant and equal to a desired reference pathlength. The Hyde subreflector, however, (a) only corrects for on-axis aberration of the torus (similar to spherical aberration), (b) only compensates for aberrations when positioned in the far field of the feed, and (c) can be used to produce offset beams in only one plane.

It has, however, been found that the dominant aberration introduced in the off-axis position of reflector antennas is astigmatism, which aberration has not been corrected by the prior art antenna systems. The problem, therefore, remaining is to provide apparatus for the correction of astigmatism in off-axis fed reflector antennas and especially in multibeam reflector antennas.

SUMMARY OF THE INVENTION

The present invention relates to launcher reflectors which are used in reflector antennas to correct for astigmatism in signals radiated and/or received at a feedhorn located in an off-axis position and, more particularly, to launcher reflectors, for use in reflector antennas, which have the curvature and orientation of their two orthogonal principal planes of curvature chosen in accordance with a particular relationship to substantially correct for astigmatism introduced in the waveform radiated and/or received at an off-axis position.

In accordance with the present invention a separate astigmatic launcher reflector is associated with each off-axis feedhorn to correct for the astigmatic aberration produced by the reflector antenna system.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

The present invention is described primarily in relationship to an offset Cassegrainian antenna system. However, it is to be understood that such description is exemplary only and is for purposes of exposition and not for purposes of limitation. It will be readily appreciated by persons skilled in the art that the inventive concept described is equally applicable to correcting astigmatism in off-axis feeds in other types of symmetrical and offset reflector antennas.

In satellite communications systems it is advantageous for both the antenna placed on the satellite and the antenna located at the ground station to be capable of simultaneously forming several independent beams pointing in different directions. For the satellite antenna this allows frequency reuse as the beam pointed to one city does not interfere with that aimed at another city, whereas, for the ground station antenna the use of multiple beams enables it to independently communicate with several satellites simultaneously, an economical arrangement.

Since only one of the beams can be aimed along the axis of the antenna reflector, the other beams suffer degradation in pattern and gain because they are oriented away from the axis. Pattern and gain degradation may be minimized by known sophisticated reflector designs. However, this usually requires an increase in reflector area.

The offset Cassegrainian antenna has many attractive features for communication satellite applications. For example, such antenna has no aperture blockage, good return loss, low sidelobes, and low cross polarization. Because of its long effective focal length, it can be made to scan the fairly large angles off-axis without severe pattern and gain degradation. However, as will be shown, this scanning capability can be increased many times by feeding the antenna with properly designed launchers.

Figure 1:
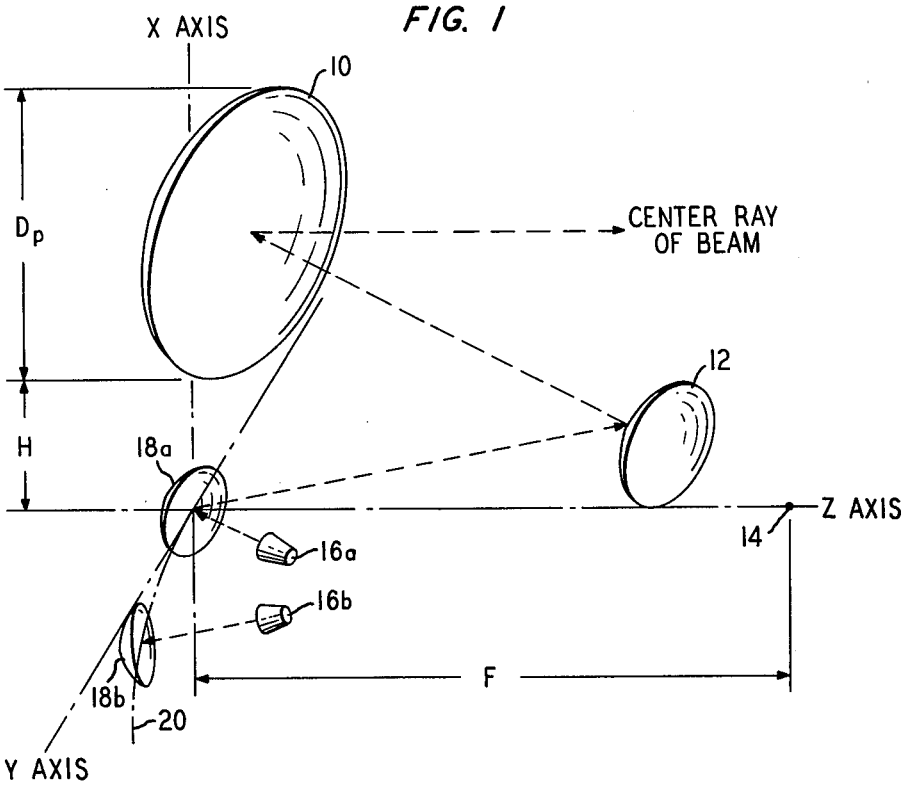
FIG. 1 illustrates an offset Cassegrainian antenna including an astigmatic launcher reflector according to the present invention.

FIG. 1 illustrates an arrangement for an exemplary offset Cassegrainian antenna system arranged in accordance with the present invention which includes the common components of a paraboloid main reflector 10, a hyperboloid subreflector 12 disposed between the main reflector 10 and its primary focus 14 in the XZ plane, and a feedhorn such as, for example, feedhorn 16*a*. A parabolic launcher reflector 18*a*, hereinafter referred to as an uncorrected launcher reflector, is disposed at the secondary focus to reflect the electromagnetic waves radiated from the associated feedhorn 16*a* towards subreflector 12 and, in turn, towards main reflector 10 for transmission as a planar wavefront in a first scanning direction or to a designated receiving station (not shown). An astigmatic launcher reflector 18*b* formed in accordance with the present invention to compensate for astigmatism in the off-axis position and hereinafter referred to as an astigmatic launcher reflector, is shown disposed to reflect electromagnetic waves radiated from the associated off-axis feedhorn 16*b* towards subreflector 12 and main reflector 10 for transmission in a second scanning direction or to a second designated receiving station (also not shown). Astigmatic launcher reflector 18*b* can also be considered to show a position of uncorrected launcher reflector 18*a* if it were to move laterally along locus 20 in the YZ axial plane to achieve a scanning operation around the X axis.

Figure 2:
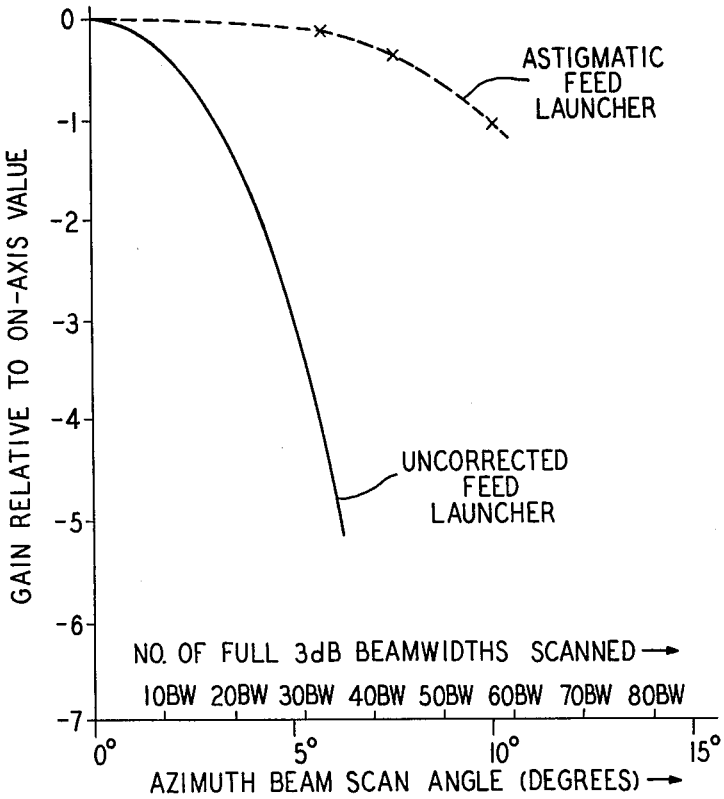
FIG. 2 illustrates the curves of the gain versus scan angle for both the uncorrected launcher reflector and the astigmatic launcher reflector according to the present invention for a transmission frequency of 13 GHz.
Figure 3:
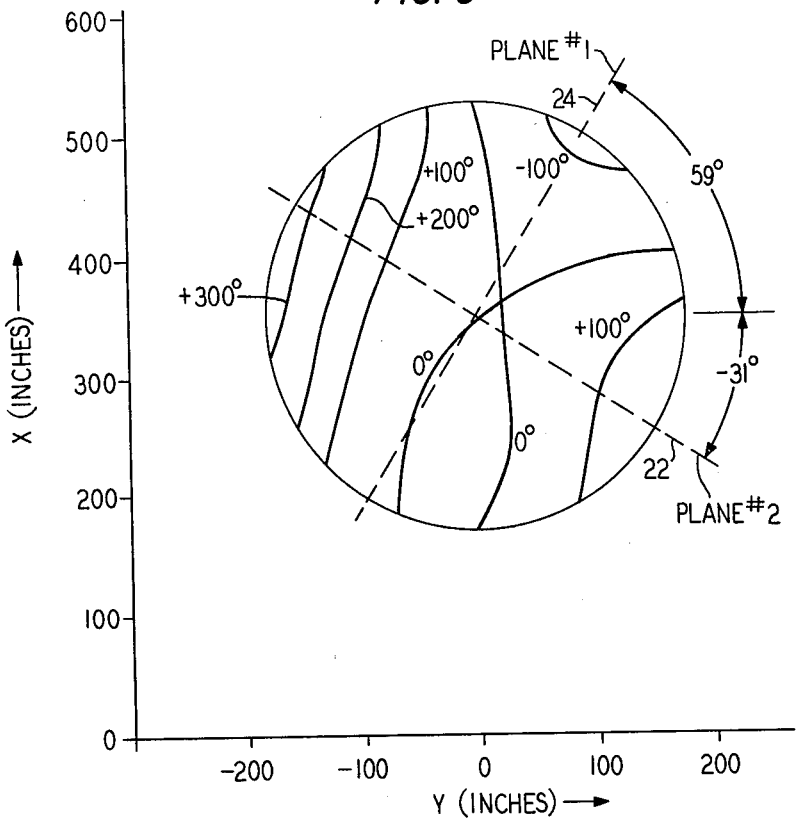
FIGS. 3 and 4 illustrate the aperture phase distribution and the amplitude distribution, respectively, at 13 GHz for an exemplary uncorrected launcher reflector.
Figure 4:
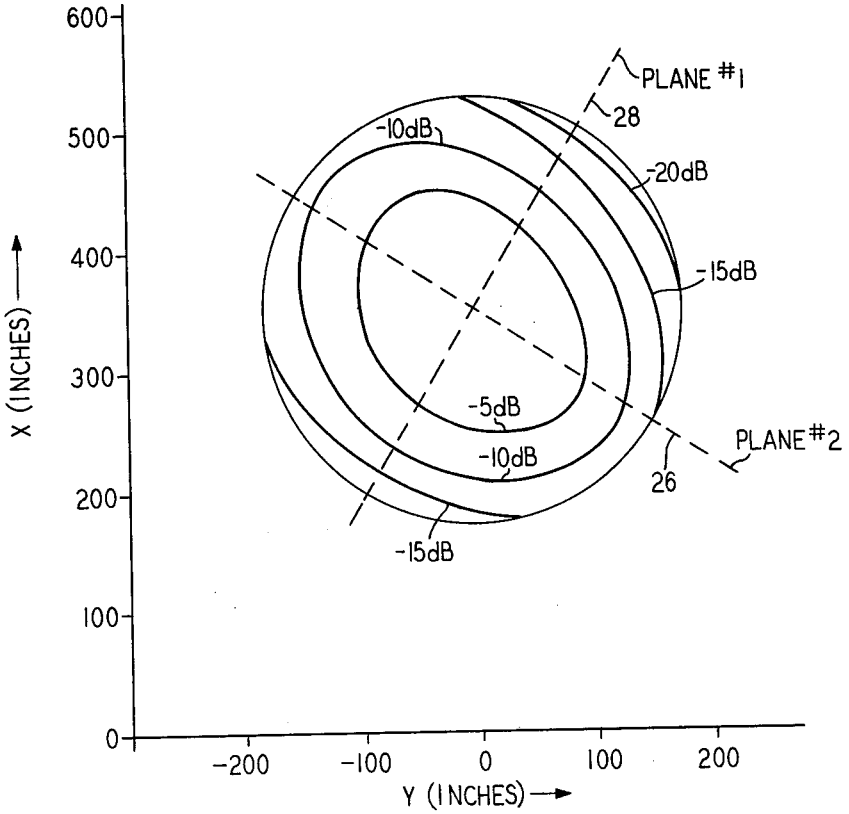

To more fully understand the present invention, a conventional offset Cassegrainian antenna system including main reflector 10, subreflector 12 and a feedhorn (not shown) positioned at the location of uncorrected launcher reflector 18*a* on locus 20 will be considered. From a numerical technique based on geometric optics, the field in the aperture of reflector 10 can be determined from the feed pattern for any specified feed location. The aperture field is numerically integrated to obtain the radiation pattern and gain of the overall antenna. Assuming a symmetrical Gaussian launcher designed to give −15 dB taper at the edge of the main reflector 10 when the feed is at the secondary focus, such as the location where the X, Y and Z axes meet in FIG. 1, to produce the on-axis beam, the resulting gain degradation, introduced as the beam is scanned in azimuth around the X axis by laterally displacing the feed along locus 20, is shown by the solid line in FIG. 2. As the beam is scanned laterally the feed remains unchanged with its center ray striking the center of the aperture, and it is moved towards the subreflector 12 to the point of optimum gain. As seen from the curve, the uncorrected launcher is not able to scan a required 10 degrees, or even 4 degrees, without excessive degradation of gain. This degradation is due mainly to phase error in the aperture. FIG. 3 shows the phase distribution and FIG. 4 the amplitude distribution of the aperture field when the uncorrected launcher is located such that a beam oriented 5.95 degrees in azimuth from the axis is produced. The launcher is moved 100 inches laterally, and 20 inches forward of a line through the axial focal point along the locus of focus 20 shown in FIG. 1. As can be seen from FIG. 3, the dominant aberration is astigmatism; a saddle-shaped phase error with symmetry axes 22 and 24 tilted −31 degrees and +59 degrees to horizontal, respectively. FIG. 4 shows that the azimuth scan has caused the amplitude distribution to be somewhat asymmetrical; however the amplitude asymmetry is not enough to cause significant degradation in gain. The symmetry axes 26 and 28 of the amplitude contours in FIG. 4 are roughly aligned with the symmetry axes 22 and 24, respectively, of the phase contours in FIG. 3 so the beam has simple astigmatism and its amplitude contours should not rotate as one progresses along the beam center ray, as opposed to beams with general astigmatism.

In accordance with the present invention, an astigmatic launcher reflector 18 is used whose radiation pattern in one plane has a phase center displaced from that in the orthogonal plane. This will make its phase pattern in the far field saddle shaped so as to compensate for the astigmatism associated with beam scanning. Since the beam-scanning astigmatism is a function of scan angle, the feed design must differ for each beam direction.

Figure 5:
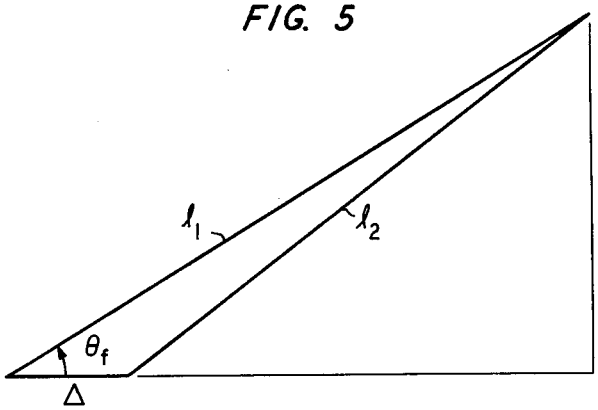
FIG. 5 illustrates a curve of the effect of a displaced phase center on the path length of the beam being considered.

As an example, it will be shown how the appropriate feed design is determined for the 5.95 degree azimuth beam direction case of FIGS. 3 and 4. Along the −31 degree axis 22 in FIG. 3, the phase advances an average of 305 degrees from the center to the edge of the aperture. The ray from the feed that corresponds to the edge is at an angle of $\theta_f = 10$ from the center ray. In order that a feed have a phase retardation of $\Phi = 305°$ in going from the center ray to $\theta_f = 10°$ its phase center in plane 2 designated 22 should be displaced by, as shown in FIG. 5, $$\Delta = \frac{\lambda}{\pi} \frac{\phi}{\theta_f^2} \left( \frac{180}{\pi} \right) = 50.5'' \quad (1)$$

where at an exemplary 13 GHz the wavelength is $\lambda = 0.908''$.

Since the phase error in the first plane 24 required negligible change in the phase front radius of curvature, its magnitude in that plane should be kept at its original value $R_1 = 269.2''$; therefore, $R_2 = 218.7''$ is the phase front radius of curvature in the second plane 22.

From FIG. 4 it can be seen that the edge taper has changed from its original value $T_o=15$ dB to about 20 dB in the first plane 28 and to 10 dB in the second plane 26. If the feed pattern in first plane 28 were to have $T_1=+5$ dB less taper at the edge of the aperture and $T_2=-5$ dB more taper in the second plane 26, the aperture illumination would be more symmetrical. Thus, if $\xi_1$ and $\xi_2$ denote the corresponding new values for the first and second planes, respectively, then for Gaussian beams, $$\xi_n = \frac{\xi_o}{\sqrt{1-\frac{T_n}{T_o}}}\ ;\ n = 1, 2 \cdot \tag{2}$$

For the example under consideration, $\xi_o=25.6''$, so that $$\xi_1=31.4'', \text{ and } \xi_2=22.1''. \tag{3}$$

A Gaussian beam with different radii of curvature $R_1$ and $R_2$ of far field phase front and different beam sizes $\xi_1$ and $\xi_2$ in two orthogonal planes will have a different beam waist diameter and location in those two planes. The distance, $\Delta Z$, between beam waists along the beam axis (Z axis of FIG. 1) using the far field approximation of the formulas disclosed in the article "Gaussian Light Beams with General Astigmatism" by J. A. Arnaud et al. in *Applied Optics*, Vol. 8, No. 8, August 1969 at pp. 1687–1693 is $$\Delta Z \approx R_2 = R_2 = 50.5'', \tag{4}$$

and the beam waists in the first and second planes have 1/e power radii of $$\bar{\xi}_1 \approx \frac{\lambda R_1}{2\pi\xi_1} = 1.235'',$$

$$\bar{\xi}_2 = \frac{\lambda R_2}{2\pi\xi_2} = 1.002''. \tag{5}$$

Figure 6:
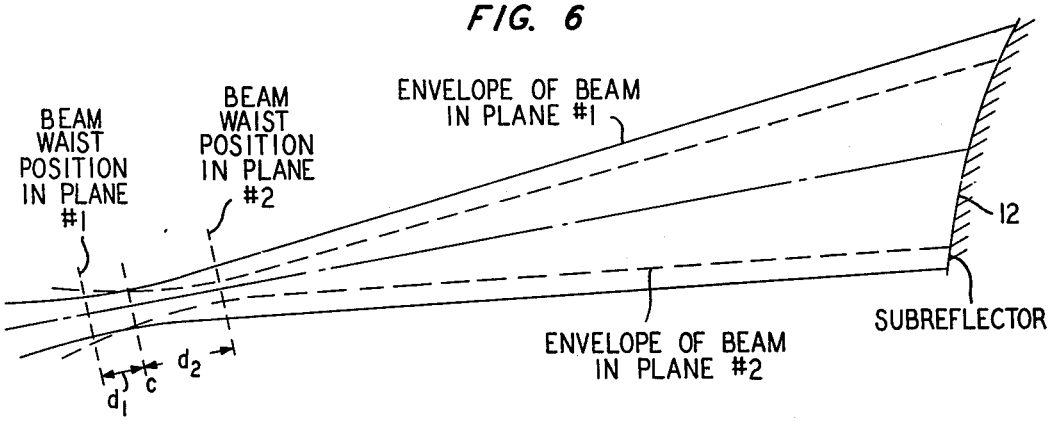
FIG. 6 is a schematic representation of a Gaussian beam with simple astigmatism.

In FIG. 6 the beam to subreflector 12 is shown with the beam envelope in the first plane 24 and 28 shown as a solid line and that in the second plane 22 and 26 shown dashed, in order to depict schematically the three dimensional beam on a two-dimensional drawing.

At a point, C, between the two beam waists the 1/e power radii in the two planes are equal. Let $d_1$ denote the axial distance from the beam waist in the first plane to point C and $d_2$ that to the beam waist in the second plane. Then $$d_1 = \frac{\Delta Z}{\tau} - \sqrt{\left(\frac{\Delta Z\bar{\xi}_2}{\tau\bar{\xi}_1}\right)^2 + \left(\frac{2\pi}{\lambda}\,\bar{\xi}_2\bar{\xi}_1\right)^2} = 27.7'' \tag{6}$$

$$d_2 = \Delta Z - d_1 = 22.8'' \tag{7}$$

where $$\tau = 1 - \left(\frac{\bar{\xi}_2}{\bar{\xi}_1}\right)^2 = 0.34 \tag{8}$$

At point C, the beam radii and phase front radii of curvature in the two planes are $$\xi_{1C} = \bar{\xi}_1\sqrt{1+\left(\frac{\lambda d_1}{2\pi\bar{\xi}_1^2}\right)^2} = 3.45'', \tag{9}$$

$$\xi_{2C} = \bar{\xi}_2\sqrt{1+\left(\frac{\lambda d_2}{2\pi\bar{\xi}_2}\right)^2} = 3.45'', \tag{10}$$

$$R_{1C} = -d_1\left[1+\left(\frac{2\pi\bar{\xi}_1^2}{\lambda d_1^2}\right)^2\right] = -31.72'', \tag{11}$$

$$R_{2C} = d_2\left[1+\left(\frac{2\pi\bar{\xi}_2^2}{\lambda d_2}\right)^2\right] = 24.92'', \tag{12}$$

where a positive phase front radius of curvature corresponds to a beam expanding in the direction of propagation. Note that $\xi_{1C}=\xi_{2C}$, as intended by the chosen position of C.

In general, the phase over a cross section of the fundamental mode Gaussian beam is an even function of the rectangular coordinates (u,v) of that plane, centered on the axis of the beam, $$\Phi(u,v) = \sum_{n=1}^{\infty}(a_n u^{2n} + b_n v^{2n}) + \sum_{m=1}^{\infty}\sum_{n=1}^{\infty} c_{mn}u^{2m}v^{2n}. \tag{13}$$

The paraxial ray approximation used in determining the propagation of Gaussian beams neglects terms of fourth order and higher in u and v and is $$\Phi(u,v) \approx a_1u^2 + b_1v^2. \tag{14}$$

Because the paraxial ray approximation is employed, there is no advantage in determining the launcher reflector, used to correct astigmatism, to fourth and higher order terms. Thus, the equation of the reflector is $$z = \frac{x^2}{2R_{s\parallel}} + \frac{y^2}{2R_{s\perp}}, \tag{15}$$

where $R_{s\parallel}$ is the radius of curvature of the reflector in the plane of incidence and $R_{s\perp}$ is that perpendicular to the plane of incidence, z is the distance normal to the surface on the illuminated side, and x and y are the corresponding Cartesian coordinates transverse to the surface. A positive $R_s$ indicates concave curvature.

If the depth of the reflector is small relative to the diameter of the beam, an incident beam with concentric circular intensity profiles at the reflector results in a reflected beam with approximately concentric circular intensity profiles at the reflector. As the beam propagates from the reflector the intensity profiles will in general become elliptical. Deep offset reflectors require the superposition of at least two modes to adequately represent the reflected beam.

If a beam represented by Equation (15) is incident on the reflector with the angle of incidence, $\theta_i$, between the center ray and the z axis, and with the radii of phase front curvature, $R_{i\parallel}$ and $R_{i\perp}$, in and perpendicular to the plane of incidence, then the phase front radii of curvature of the reflected beam at the reflector are $$\frac{1}{R_{r\parallel}} = \frac{1}{R_{i\parallel\psi}} - \frac{2}{\cos\theta_i R_{s\parallel}} \tag{16}$$

and

-continued $$\frac{1}{R_{r\perp}} = \frac{1}{R_{i\perp}} - \frac{2\cos\theta_i}{R_{s\perp}}. \tag{17}$$

Since the reflector is to refocus the beam to a single common focus $R_{r\perp}=R_{r\parallel} \triangleq R_r$ and $$R_{s\parallel} = \frac{2}{\cos\theta_i}\left[\frac{R_{i\parallel} R_r}{R_r - R_{i\parallel}}\right], \text{ and} \tag{18}$$

$$R_{s\perp} = 2\cos\theta_i\left[\frac{R_{i\perp} R_r}{R_r - R_{i\perp}}\right]. \tag{19}$$

Note that the proper focusing of the beam with simple astigmatism is achieved with a surface, one of whose principal planes of curvature is coplanar with one of the principal planes of curvature of the phase front of the incident beam and with the plane of incidence.

From Equation (15), the astigmatism can be corrected by a doubly curved launcher reflector, one of whose principal planes of curvature is coplanar with the plane of incidence which is in turn coplanar with one of the principal planes of curvature of the phase front of the incident beam such as plane No. 1 or plane No. 2 of FIG. 3. As a specific example plane No. 2 is chosen as the plane of incidence, and $$R_{i\parallel}=R_{2C}, R_{i\perp}=R_{1C}. \tag{20}$$

From Equations (18) and (19), it follows that the radii of curvature of the surface of astigmatism launcher reflector 18*b*, for example, are $$\left.\begin{aligned} R_{s\parallel} &= \frac{2}{\cos\theta_i}\left(\frac{R_{2C} R_r}{R_r - R_{2C}}\right) \\ R_{s\perp} &= 2\cos\theta_i\left(\frac{R_{1C} R_r}{R_r - R_{1C}}\right). \end{aligned}\right\} \tag{21}$$

The radius of curvature, $R_r$, of the beam reflected from the astigmatic launcher reflector 18 towards its feedhorn 16 and the angle of incidence, $\theta_1$, are chosen to provide a convenient size feedhorn and to prevent the feedhorn 16 from blocking the launcher reflector aperture.

Since $R_{1C}$ is negative for the example being considered, as is $R_r$, it is possible to choose $R_r=R_{1C}=-31.72''$ which, from Equation (21), implies $R_{s\perp}=\infty$ so that the astigmatic launcher reflector becomes a cylindrical mirror. Furthermore, since the astigmatic launcher reflector has no curvature in the direction perpendicular to the plane of incidence, it does not introduce any cross polarization coupling.

If one uses a corrugated horn 16*b*, for example, to feed the launcher reflector 18*b*, its size and shape may be determined from $R_r$ and $\xi_C=\xi_{1C}=\xi_{2C}$.

The horn generates a Gaussian beam whose beam waist radius is $$\overline{\xi_h} = \frac{\xi_c}{\sqrt{1+\left(\frac{2\pi\xi_c^2}{\lambda R_r}\right)^2}} = 1.24'' \tag{22}$$

at a distance $$d_h = \frac{R_r}{1+\left(\frac{\lambda R_r}{2\pi\xi_c^2}\right)^2} = 27.62'' \tag{23}$$

from the launcher reflector 18*b*. As shown in the article "An Improved Antenna for Microwave Radio Systems Consisting of Two Cylinderical Reflectors and a Corrugated Horn" by C. Dragone, *The Bell System Technical Journal*, Vol. 53, No. 7, September 1974 at pp. 1351–1377, if the horn aperture is placed at a distance $d_a$ from the beam waist where the beam radius is $$\xi_a = \overline{\xi_h} = \sqrt{1+\left(\frac{\lambda d_a}{2\pi\overline{\xi_h}^2}\right)^2}, \tag{24}$$

and the phase front radius of curvature is $$R_a = d_a\left[1+\left(\frac{2\pi\overline{\xi_h}^2}{\lambda d_a}\right)^2\right], \tag{25}$$

then the radius of the horn aperture, to the edge of the corrugations, must be $$a_h = \frac{2\,\xi_a}{0.6437} = 2.197\xi_a \tag{26}$$

and the conical taper of the inside of the horn 16 must have a length, from aperture to conical vertex, of $$l_h=R_a. \tag{27}$$

Figure 7:
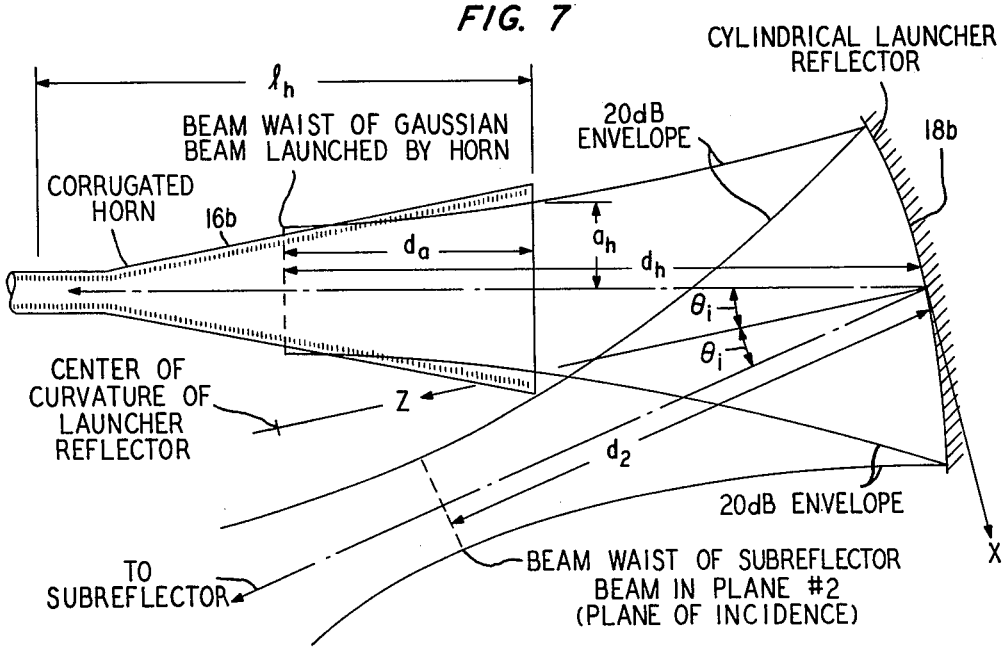
FIG. 7 is a cross-sectional view of an exemplary astigmatic launcher reflector in accordance with the present invention for the exemplary offset Cassegrainian antenna of FIG. 1.

One possible choice which often yields the least expensive horn is that with minimum length, $$\frac{dl_h}{dd_a} = O \rightarrow d_a = \frac{2\pi\overline{\xi_h}^2}{\lambda} = 10.64'', \tag{28}$$

so that $a_h=3.853''$ and $l_h=21.28''$. Since the horn corrugations are generally about $\lambda/4$ deep at the lowest frequency of concern and the outside horn wall is typically about another $\lambda/4$ thick, as shown in FIG. 7, an incidence angle of $\theta_i \geqq 11.38$ is required so that the horn will not block the beam inside its −20 dB intensity profile. From Equation (21), this implies $R_{s\parallel}=28.52''$ when $\theta_i=11.83$, so that the depth of the reflector surface from the 20 dB contour relative to its center is 0.96".

Figure 8:
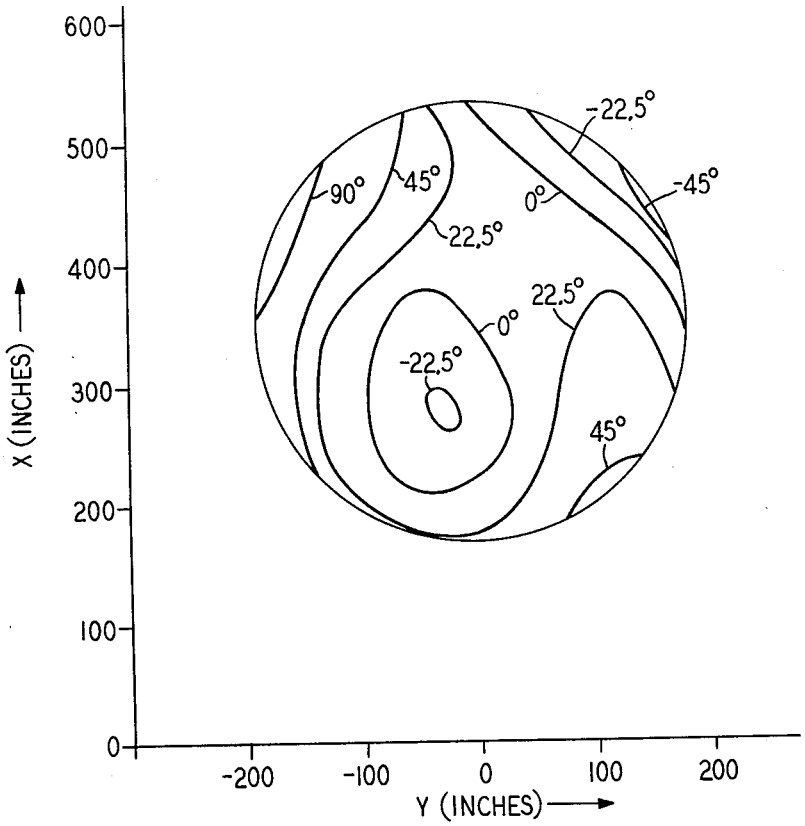
FIG. 8 illustrates the aperture phase distribution for the exemplary astigmatic launcher reflector of FIG. 7.

Using numerical computation methods described in the article "Numerical Analysis of Multiple-Beam Offset Cassegrainian Antennas" by E. A. Ohm et al. in *AIAA/CASI 6th Communications Satellite Systems Conference*, Montreal, Canada, Paper 76-301, Apr. 8, 1976, the phase error in the main aperture when subreflector 12 is illuminated by the Gaussian beam with simple astigmatism, generated by the astigmatic launcher reflector of FIG. 7, is shown in FIG. 8. By comparison with FIG. 3 it is seen that the astigmatic launcher reflector has reduced the phase error significantly, leaving a phase aberration predominatly of the coma type. Because of the presence of other aberrations it is often necessary to reposition the astigmatic launcher relative to the position of the uncorrected launcher for optimum gain. Also since the beam astigmatism requiring correction is only approximately estimated by the above method, successive corrections using the numerical computation method mentioned hereinabove may be required. The gain degradation due to scanning is significantly reduced by using astigmatic launcher reflectors as shown by the example computations for several azimuth scan angles indicated as crosses in FIG. 2. By using astigmatic launcher reflectors, one can scan about three times as far, compared with uncorrected launchers, with the exemplary Cassegrainian antenna exhibiting less than 1 dB degradation in gain. If correction for coma is also obtained by using launcher reflectors which generated higher order Gaussian modes, for example, the useful range of scan angles could be increased even further.

Figure 9:
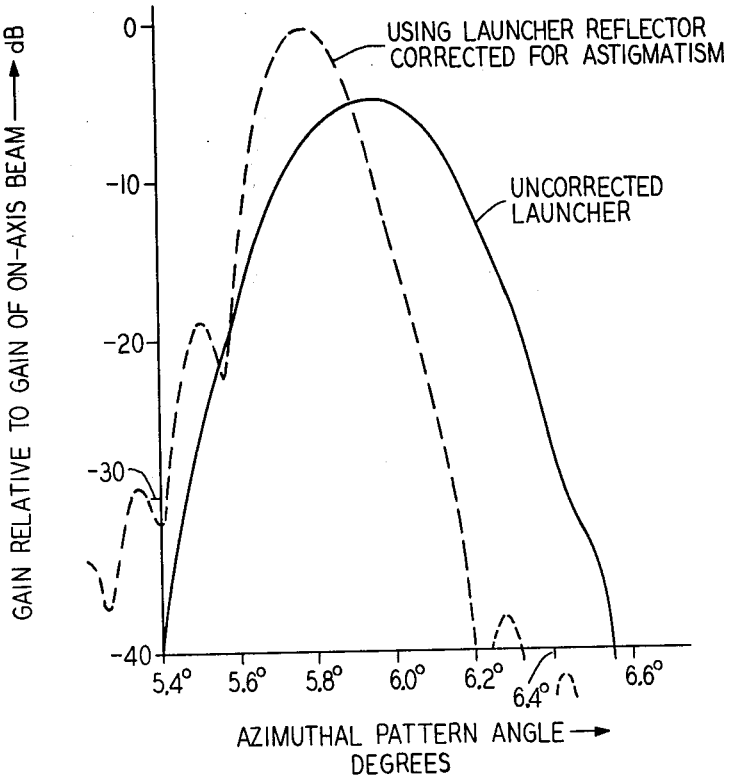
FIG. 9 is a curve showing a comparison of the radiation patterns for an uncorrected launcher reflector and an astigmatic launcher reflector in accordance with the present invention.

FIG. 9 shows that a significant portion of the pattern degradation, experienced when the uncorrected launcher is moved to produce an off-axis beam, may be eliminated by using an astigmatic launcher reflector in accordance with the present invention. The solid curve shows the radiation pattern in the plane through the beam maximum and the antenna axis ($\phi = -92.7°$) for the uncorrected launcher positioned as for FIGS. 3 and 4. It is to be noted that the near-in side lobes have been merged into the main beam so that it is wider and falls off more slowly than that for the astigmatic launcher reflector shown as a dashed curve. After correcting the launcher for astigmatism it is usually necessary to reposition it backwards (8" for the above example) for best focusing. As a result the direction of the beam maximum is slightly displaced (0.2° for the above example) and the tilt of the plane through the beam maximum and the antenna axis has a slightly different tilt (−94.3° for the above example).

From the above discussion, it has been shown that astigmatism in a reflector antenna system may be corrected to a large degree by using astigmatic launcher reflectors consisting in general of a doubly curved reflector fed by a feedhorn with a symmetrical pattern. Often the astigmatic launcher reflector may be flat in one plane (cylindrical reflector) without imposing too large a size for the feedhorn, providing the distance between beam waists of the Gaussian beam with the required simple astigmatism is not too large. The least cross polarization coupling is obtained when the plane of incidence is chosen coplanar with plane of maximum curvature of the launcher reflector.

It is to be understood that the above-described embodiments are simply illustrative of the principles of the invention. Various other modifications and changes may be made by those skilled in the art which will embody the principles of the invention and fall within the spirit and scope thereof. For example, where the main reflector produces astigmatism even in the on-axis case, the present astigmatic launcher reflector can be used to overcome such astigmatism.

What is claimed is:

1. A method of correcting for astigmatism in a beam of electromagnetic radiation which is either one of radiated and received by an antenna system comprising a main reflector and a feedhorn, the method comprising the step of:

(a) reflecting the beam propagating in either direction between the main reflector and the feedhorn off a launcher reflector disposed between the main reflector and the feedhorn along the feed axis of the beam, the launcher reflector comprising a radius of curvature in two orthogonal planes according to the relationships $$R_{s\parallel} = \frac{2}{\cos\theta_i}\left(\frac{R_{2C}R_r}{R_r - R_{2C}}\right) \text{and}$$

$$R_{s\perp} = 2\cos\theta_i\left(\frac{R_{1C}R_r}{R_r - R_{1C}}\right)$$

where $R_{s\parallel}$ is the radius of curvature of the launcher reflector in the plane of incidence, $R_{s\perp}$ is the radius of curvature of the launcher reflector perpendicular to the plane of incidence, $R_r$ is the radius of curvature of the beam propagating between the feedhorn and the launcher reflector in the area adjacent to the launcher reflector, $\theta_i$ is the angle of incidence, and $R_{2C}$ and $R_{1C}$ are the radii of phase front curvature in and perpendicular to the plane of incidence, respectively, with respect to electromagnetic waves propagating along the feed axis of the beam between the main reflector and the launcher reflector in the area adjacent to the launcher reflector.

2. A launcher reflector for use in a reflecting antenna system, which includes a main reflector, and a feedhorn, for correcting for astigmatism in a beam which is either one of radiated towards and received from a particular direction, the launcher reflector comprising a radius of curvature in two orthogonal planes according to the relationships $$R_{s\parallel} = \frac{2}{\cos\theta_i}\left(\frac{R_{2C}R_r}{R_r - R_{2C}}\right) \text{and}$$

$$R_{s\perp} = 2\cos\theta_i\left(\frac{R_{1C}R_r}{R_r - R_{1C}}\right)$$

where $R_{s\parallel}$ is the radius of curvature of the launcher reflector in the plane of incidence, $R_{s\perp}$ is the radius of curvature of the launcher reflector perpendicular to the plane of incidence, $R_r$ is the radius of curvature of the beam propagating between the feedhorn and the launcher reflector in the area adjacent to the launcher reflector, $\theta_1$ is the angle of incidence, and $R_{2C}$ and $R_{1C}$ are the radii of phase front curvature in and perpendicular to the plane of incidence, respectively, with respect to electromagnetic waves propagating along the feed axis of the beam between the main reflector and the launcher reflector in the area adjacent to the launcher reflector.

3. A reflecting antenna system for correcting for astigmatism in a beam which is either one of radiated and received by the antenna system comprising in combination:

a main focusing reflector;

a feedhorn disposed to permit either one of the radiating the beam in a particular direction and receiving the beam from a particular direction by the antenna system; and a launcher reflector disposed to reflect said beam propagating in either direction along the feed axis of the beam between said feedhorn and said main reflector, the launcher reflector comprising a radius of curvature in two orthogonal planes according to the relationships $$R_{s\parallel} = \frac{2}{\cos\theta_i}\left(\frac{R_{2C}R_r}{R_r - R_{2C}}\right) \text{and}$$

$$R_{s\perp} = 2\cos\theta_i\left(\frac{R_{1C}R_r}{R_r - R_{1C}}\right)$$

where $R_{s\parallel}$ is the radius of curvature of the launcher reflector in the plane of incidence, $R_{s\perp}$ is the radius of curvature of the launcher reflector perpendicular to the plane of incidence, $R_r$ is the radius of curvature of the beam propagating between the feedhorn and the launcher reflector in the area adjacent to the launcher reflector, $\theta_i$ is the angle of incidence, and $R_{2C}$ and R;hd 1C are the radii of phase front curvature in and perpendicular to the plane of incidence, respectively, with respect to electromagetic waves propagating along the feed axis of the beam between the main reflector and the launcher reflector in the area adjacent to the launcher reflector.

4. A reflecting antenna system according to claim 3 wherein said antenna system further comprises at least a second feedhorn disposed at a separate off-axis location; and at least a second launcher reflector which is associated with said at least second feedhorn and is formed to have a radius of curvature in two orthogonal planes in accordance with the same relationships used to form said first launcher reflector.

* * * * *

UNITED STATES PATENT AND TRADEMARK OFFICE

CERTIFICATE OF CORRECTION

PATENT NO. : 4,145,695

DATED : March 20, 1979

INVENTOR(S) : Michael J. Gans

It is certified that error appears in the above-identified patent and that said Letters Patent are hereby corrected as shown below:

Column 5, Equation (4) that portion of the formula reading "$R_2$=" should read --$R_1$- --. Column 6, Equation (10) that portion of the formula reading "$2\pi\bar{\xi}_2$" should read --$2\pi\bar{\xi}_2{}^2$--. Column 6, Equation (11) that portion of the formula reading "$\lambda d_1{}^2$" should read --$\lambda d_1$--.

Column 6, Equation (14) that portion of the formula reading "y" should read --v--.

Column 7, line 46 change "$\theta_1$" to read --$\theta_i$--. Column 10, line 46 "$\theta_1$" should read --$\theta_i$--. Column 11, line 14 change "R;hd" should read --$R_{1C}$--. Column 11, line 15 delete 1C.

Signed and Sealed this

*Thirty-first* Day of *July 1979*

[SEAL]

*Attest:*

*Attesting Officer*

LUTRELLE F. PARKER

*Acting Commissioner of Patents and Trademarks*